US009863081B2

(12) United States Patent
Carter

(10) Patent No.: US 9,863,081 B2
(45) Date of Patent: Jan. 9, 2018

(54) DETACHABLE STEAMING COMPONENT CONNECTED TO A STEAMING SYSTEM WITH A DETACHABLE STEAMER BAG

(71) Applicant: Abdul Sean Carter, Brooklyn, NY (US)

(72) Inventor: Abdul Sean Carter, Brooklyn, NY (US)

( * ) Notice: Subject to any disclaimer, the term of this patent is extended or adjusted under 35 U.S.C. 154(b) by 0 days.

(21) Appl. No.: 14/919,937

(22) Filed: Oct. 22, 2015

(65) Prior Publication Data

US 2017/0114492 A1 Apr. 27, 2017

(51) Int. Cl.

| | |
|---|---|
| ***D06F 35/00*** | (2006.01) |
| ***D06F 39/00*** | (2006.01) |
| ***D06F 71/34*** | (2006.01) |
| ***D06F 73/00*** | (2006.01) |
| ***D06F 73/02*** | (2006.01) |
| ***D06F 75/06*** | (2006.01) |
| ***D06F 75/10*** | (2006.01) |
| ***D06F 75/12*** | (2006.01) |
| ***D06F 75/14*** | (2006.01) |
| ***D06F 75/16*** | (2006.01) |
| ***D06F 75/18*** | (2006.01) |
| ***D06F 75/20*** | (2006.01) |

(52) U.S. Cl.

CPC ..... *D06F 39/008* (2013.01); *D06F 35/00* (2013.01); *D06F 71/34* (2013.01); *D06F 73/00* (2013.01); *D06F 73/02* (2013.01); *D06F 75/06* (2013.01); *D06F 75/10* (2013.01); *D06F 75/12* (2013.01); *D06F 75/14* (2013.01); *D06F 75/16* (2013.01); *D06F 75/18* (2013.01); *D06F 75/20* (2013.01)

(58) Field of Classification Search

CPC ..... D06F 35/00; D06F 39/008; D06F 71/34; D06F 73/00; D06F 73/02; D06F 75/06; D06F 75/10; D06F 75/12; D06F 75/14; D06F 75/16; D06F 75/18; D06F 75/20

USPC ..... 8/149.3; 68/5 R, 222

See application file for complete search history.

(56) References Cited

U.S. PATENT DOCUMENTS

2004/0163184 A1* 8/2004 Waldron ..... D06F 73/02 8/149.1

2013/0259454 A1* 10/2013 Colburn ..... D06F 73/02 392/336

* cited by examiner

*Primary Examiner* — Levon J Shahinian

(74) *Attorney, Agent, or Firm* — Dwayne L. Bentley; DL Bentley Law Group PLLC

(57) ABSTRACT

A system for steaming clothes is disclosed. A steamer is connected through a hose to a steamer bag or a steaming component having a plurality of connecting tubes, where the steaming component having the plurality of connecting tubes, where the plurality of connecting tubes connects to a plurality of detachable ventilating tubes, where the plurality of the detachable ventilating tubes have a plurality of holes to expel steam. The steaming component with the plurality of connecting tubes are configured to hold an article of clothing that fits around the steaming component and the plurality of connecting tubes, where the steaming component is configured to receive the steam from the steamer to expel the steam through the plurality of holes to the steamer bag to entirely steam an entire portion of the article of clothing.

6 Claims, 8 Drawing Sheets

DETACHABLE STEAMING COMPONENT CONNECTED TO A STEAMING SYSTEM WITH A DETACHABLE STEAMER BAG

CROSS REFERENCE TO RELATED APPLICATION

This non-provisional continuation in part patent application claims priority to U.S. Non-Provisional Continuation in part patent application Ser. No. 14/055,035 filed on Oct. 16, 2013, which is based on a non-provisional patent application filed on Feb. 1, 2012 which is incorporated herein by reference.

FIELD OF THE INVENTION

The present invention relates to a system for steaming clothes with a steaming component in a bag.

BACKGROUND OF THE INVENTION

Generally, when a person wants to get wrinkles out of their clothes they steam the clothes themselves. Usually, a person would use a steam iron to get the wrinkles out of their clothes. A steam iron similar to a regular iron has a cord that is plugged into an electrical outlet. However, the steam iron includes a compartment that holds water that is changed to steam when it is heated by a typical heating element connected to the cord of the iron. The steam from the steam iron is used to get the wrinkles out of the clothes.

When a person utilizes a steam iron it may be time-consuming in that the person may be rushing to work and/or trying to get his/her children ready for school so the person may not have time to steam his/her clothes. Also, if the person is not careful the person may burn the person's hands or the clothes when using the steam iron. Currently, there's no hands free steam iron that allows a person to walk away from the steam iron without having to watch it to make sure an entire portion of the clothes are steamed. Also, there's no system that's safe around children and a person's clothes doesn't get burned.

Even when a steam iron is used there's a tendency that all portions of the clothing may not be thoroughly steamed because the amount of steam differentiates as you move the steam iron from one portion of clothing to another. There are also steamers that are used to steam clothes, but often they're bulky and cumbersome to utilize. Often these steamers sit in a house or an apartment without being utilized by anyone because they're too cumbersome to use and they don't easily allow someone to evenly simultaneously steam all portions of the clothes.

Therefore, there is a need for a steaming device which includes a detachable steaming component that is easy to use and hands free that enables anyone to simultaneously steam an entire portion of their clothes.

SUMMARY OF THE INVENTION

The present invention has been accomplished in view of the above-mentioned technical background, and it is an object of the present invention to provide a system for steaming articles of clothing.

In a preferred embodiment of the invention, a system for steaming clothes is disclosed. A steamer is connected through a hose to a steamer bag or steaming component having a plurality of connecting tubes, where the steaming component having the plurality of connecting tubes, where the plurality of connecting tubes connects to a plurality of detachable ventilating tubes, where the plurality of the detachable ventilating tubes have a plurality of holes to expel steam. The steaming component with the plurality of connecting tubes are configured to hold an article of clothing that fits around the steaming component and the plurality of connecting tubes, where the steaming component is configured to receive the steam from the steamer to expel the steam through the plurality of holes to entirely steam an entire portion of the article of clothing. The steamer bag is configured to hold the steam in to steam the entire portion of the article of clothing.

In another preferred embodiment of the invention, a method for steaming clothes is disclosed. The method includes: connecting a hose from a steamer to a steamer bag or a steaming component with a plurality of connecting tubes; connecting the plurality of connecting tubes to a plurality of ventilated tubes; transferring steam from the steamer to the steamer component and the plurality of connecting tubes through the plurality of ventilated tubes; transferring the steam through the plurality of ventilating tubes that includes a plurality of holes; configuring the steam bag to hold the steam in to steam the entire portion of the article of clothing; and simultaneously expelling the steam through the plurality of holes.

BRIEF DESCRIPTION OF THE DRAWINGS

These and other advantages of the present invention will become more apparent as the following description is read in conjunction with the accompanying drawings, wherein.

DETAILED DESCRIPTION OF THE INVENTION

The presently preferred embodiments of the invention are described with reference to the drawings, where like components are identified with the same numerals. The descriptions of the preferred embodiments are exemplary and are not intended to limit the scope of the invention.

Figure 1:
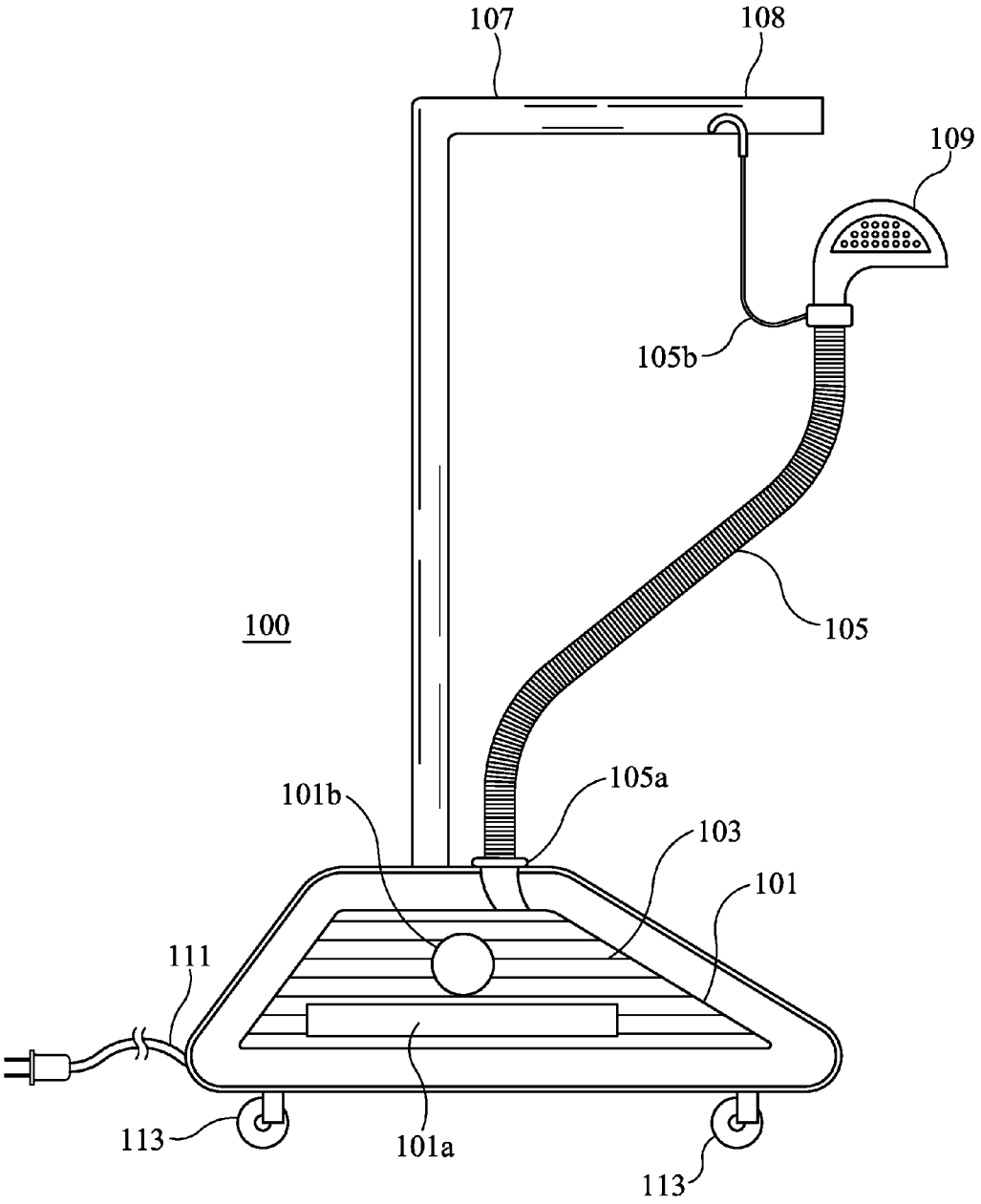
FIG. 1 is an illustration of an entire steaming system in accordance with the invention.

FIG. 1 is an illustration of an entire steaming system. A steaming system 100 is a typical steaming system with additional components. The steaming system 100 includes: a removable water tank 101, a heating element 101*a*, an OFF Level temperature/Timer operating switch 101*b*, water 103, a removable hose 105, an extendible steamer pole 107, a hanger holder 108, a detachable steamer handle 109, a retractable electrical cord 111 and wheels 113. The term "steamer" refers to the typical components associated with a steamer, such as a water tank 101, water 103, electrical cord 111, a steamer pole 107 and a hanger holder 108.

Hose 105 includes a male connector 105*a* and a female connector 105*b*. Male connector 105*a* is connected to the steaming system 100. Female connector 105*b* is connected to the steamer handle 109 through a receiving end of the steamer handle 109 that receives the female connector 105*b*.

Figure 1A:
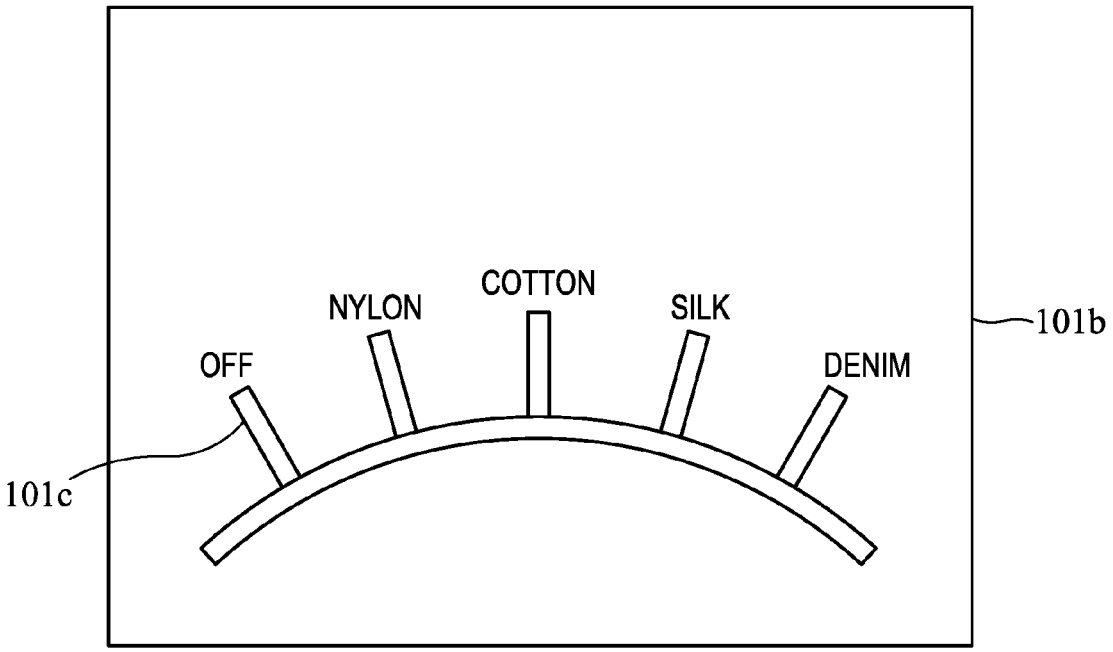
FIG. 1*a* is an illustration of an OFF Level temperature operating switch in accordance with the invention.

Referring to FIG. 1A, the OFF temperature Timer operating steam switch 101*b* referred to as a "Level switch" is shown. This Level switch 101*b* is a typical steam switch that allows a person to dictate when and how much pressure will be allowed to go through hose 105 into the handle 109. Level switch 101*b* is connected to a typical heating element 101*a* in the water tank 101 to the conventional electric cord 111 or a typical retractable electrical cord. Heating element 101*a* is a boiling means to boil the water 103 to a certain temperature so steam can be created from the boiling water 103. For example, the OFF temperature Timer Level 101*b* has a sliding portion 101*c* or rotating knob 101*c* that allows a person to choose a typical pressure setting for cotton, silk, denim and other materials which may take anywhere from 1 to 2 minutes to heat up the heating element 101*a* to cause it to steam depending on the type of material and the time it may take to steam the article of clothing. In another embodiment of the invention, the OFF Timer 101*b* may be a digital device. The OFF temperature Timer/Level 101*b* has a temperature time component that automatically shuts off at a predetermined temperature when this temperature is reached, such as 75 degrees Fahrenheit and time that it takes, for example 3-5 minutes for a pair of denim jeans. This OFF Temperature Timer/Level 101*b* shuts off automatically when the 3-5 minutes has expired for steaming the pair of denim jeans.

Figure 2:
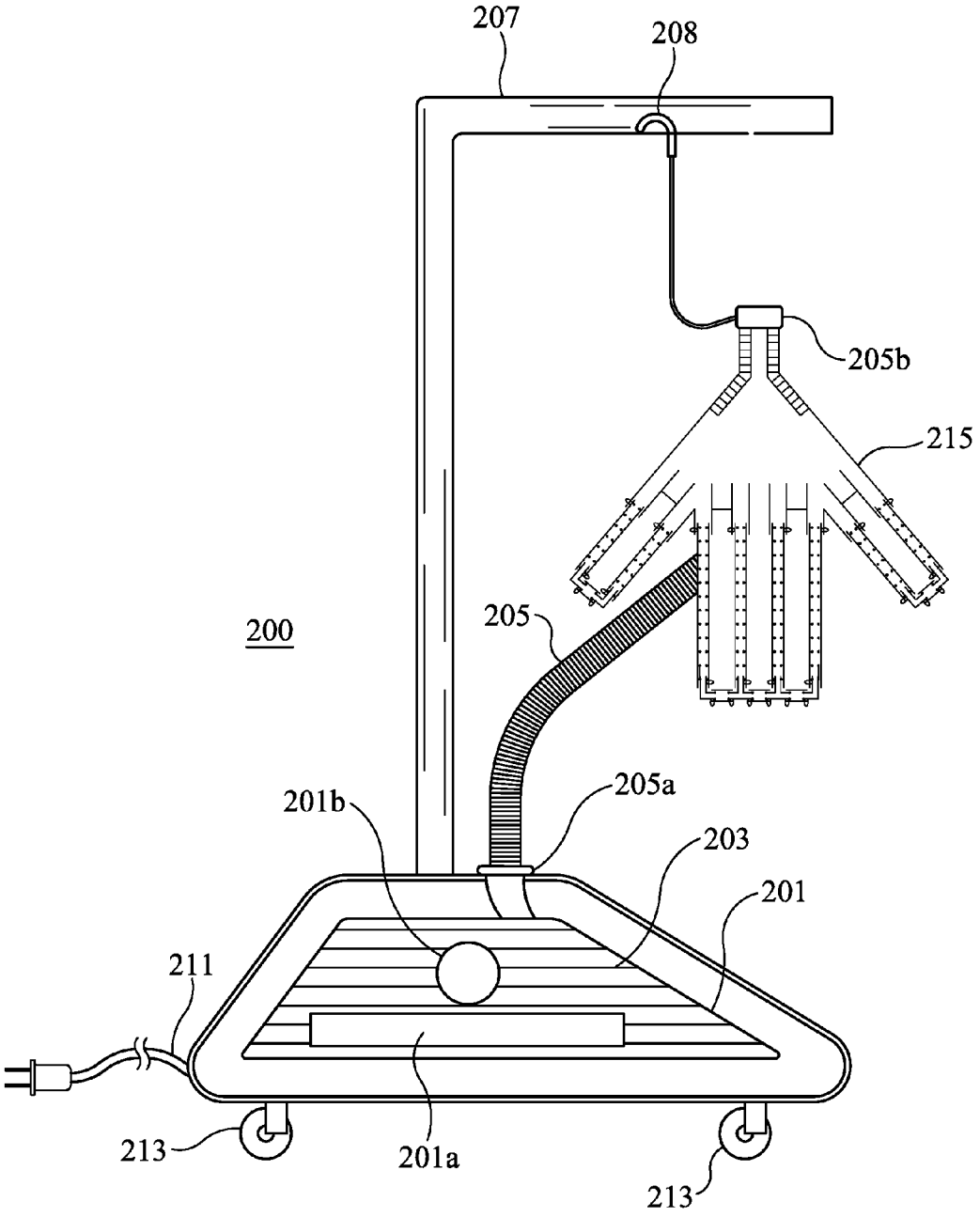
FIG. 2 is an illustration of the steaming system of FIG. 1 in accordance with the invention that also includes a detachable steaming component.

FIG. 2 is an illustration of an entire steaming system. A steaming system 200 is a typical steaming system with additional components similar to steaming system 100. The steaming system 200 includes: a removable water tank 201, water 203, a hose 205, an extendible steamer pole 207 and a hanger folder 208. Hose 205 is a removable hose that includes a male connector 205*a* and a female connector 205*b*. Male connector 205*a* is connected to the steaming system 200. Female connector 205*b* is connected to the detachable steaming component 215 by an opening that receives the female connector 205*b*. An OFF temperature Timer/Level setting steam switch 201*b* ("Level switch 201*b*") is equivalent to the OFF temperature Timer/Level operating steam switch 101*b* described above so a recitation of OFF temperature Timer/Level operating switch will not be disclosed herein. Level switch 201*b* is a typical pressure steam switch that allows a person to dictate when and how much pressure steam will be allowed to go through hose 205 into the detachable steaming component 215.

The level switch 201*b* is connected to a typical heating element 201*a* in the water tank 201 that has a conventional electric cord 211 or retractable electric cord 211. Heating element 201*a* is a boiling means to boil the water 203 to a certain temperature so steam can be created from the boiling water 203. For example, the OFF Timer/Level setting steam switch 201*b* may have a sliding portion similar to sliding portion 101*c* or rotating knob 101*c* that allows one to choose a setting for cotton, silk, denim and other materials which may take anywhere from 1 to 2 minutes to heat up the heating element 201*a* to cause it to steam depending on the type of material and the time it may take to steam the article of clothing. In another embodiment of the invention, the OFF temperature Timer/Level 201*b* may be a digital device.

Figure 3:
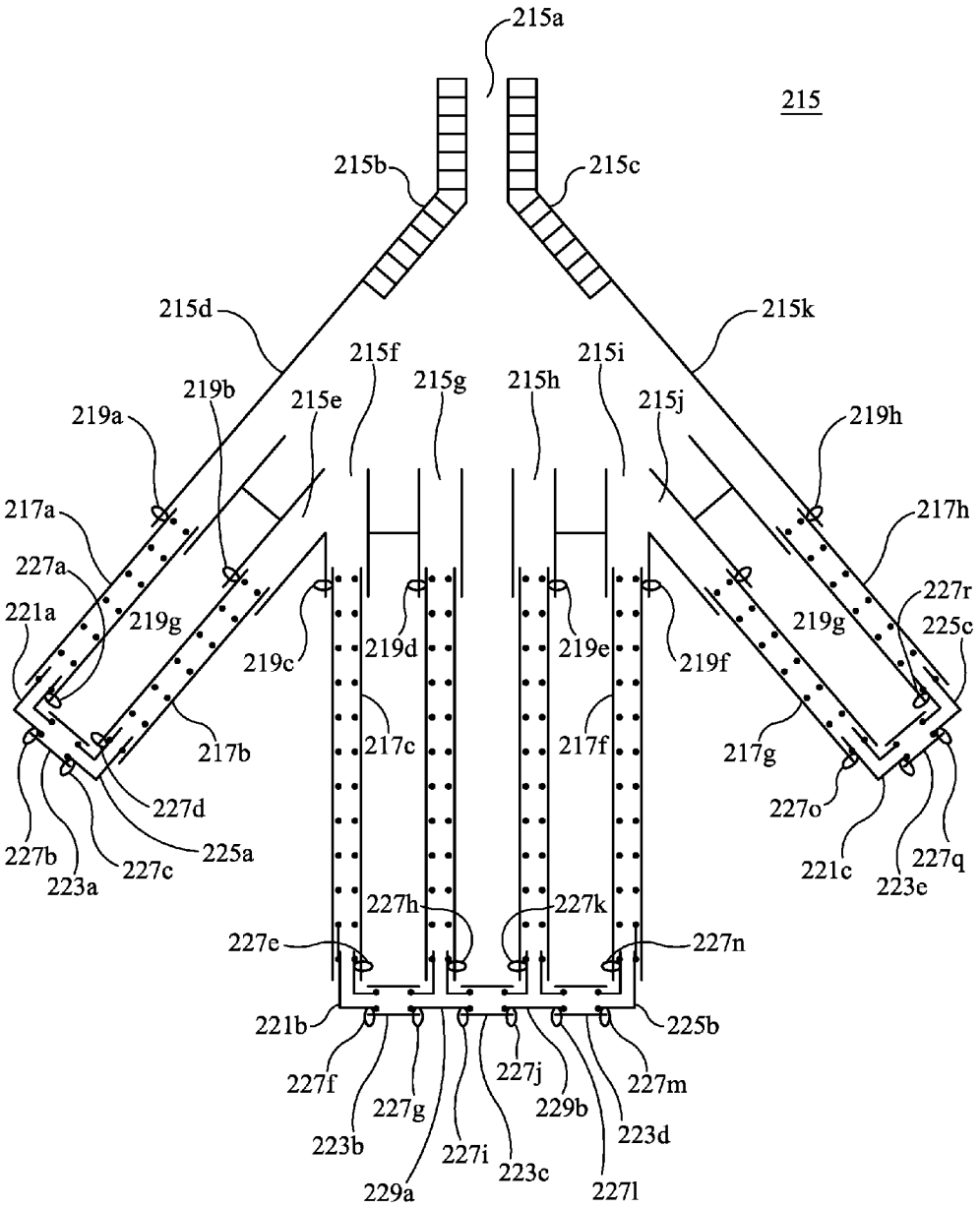
FIG. 3 shows the detachable steaming component of FIG. 2 in accordance with the invention.

As shown in FIG. 3, the detachable steaming component 215 is made of a hard durable plastic that can withstand heat, such as polyurethane, polyvinyl chloride (PVC) or polyolefin. For example, the detachable steaming component 215 may be a hollow triangular structure that is a specially molded custom-made piece. The triangular structure of the detachable steaming component 215 includes connecting tubes. In this embodiment, the detachable steaming component 215 has 8 connecting tubes 215*d*, 215*e*, 215*f*, 215*g*, 215*h*, 215*i*, 215*j* and 215*k* that each have detachable ventilated tubes 217*a*, 217*b*, 217*c*, 217*d*, 217*e*, 217*f*, 217*g* and 217*h*. Each of the connecting tubes 215*d*, 215*e*, 215*f*, 215*g*, 215*h*, 215*i*, 215*j* and 215*k* are connected by a plurality of spring connectors 219*a*, 219*b*, 219*c*, 219*d*, 219*e*, 219*f*, 219*g* and 219*h* located in each respective ventilated ("ventilating") tubes 217*a*, 217*b*, 217*c*, 217*d*, 217*e*, 217*f*, 217*g* and 217*h*. Spring connectors 219*a*, 219*b*, 219*c*, 219*d*, 219*e*, 219*f*, 219*g* and 219*h* are springs in the respective male ends of ventilated tubes 217*a*, 217*b*, 217*c*, 217*d*, 217*e*, 217*f*, 217*g* and 217*h* that pops into a respective hole of connecting tubes 215*d*, 215*e*, 215*f*, 215*g*, 215*h*, 215*i*, 215*j* and 215*k*, which connects and holds the respective connecting tubes 215*d*, 215*e*, 215*f*, 215*g*, 215*h*, 215*i*, 215*j* and 215*k* to respective ventilating tubes 217*a*, 217*b*, 217*c*, 217*d*, 217*e*, 217*f*, 217*g* and 217*h*. Spring connectors 219*a*, 219*b*, 219*c*, 219*d*, 219*e*, 219*f*, 219*g* and 219*h* are equivalent to spring connectors 227*a*, 227*b*, 227*c*, 227*d*, 227*e*, 227*f*, 227*g*, 227*h*, 227*i*, 227*j*, 227*k*, 227*l*, 227*m*, 227*n*, 227*o*, 227*p*, 227*q* and 227*r*. The detachable steaming component 215 includes vents 215*b* and 215*c* built around a collar area 215*a* of the detachable steaming component 215. Vents 215*b* and 215*c* are used to expel or dispense steam onto a collar area of a shirt that is placed around the detachable steaming component 215. The ventilating tubes 217*a*, 217*ba*, 217*c*, 217*d*, 217*e*, 217*f*, 217*g* and 217*h* have various lengths in a range of 6-36 inches and include air holes that facilitate steam coming out of them.

Connecting tube 215*d* connects to ventilating tube 217*a* having the spring connector 219*a*, where the spring connector 219*a* is a spring that pops into a hole of the connecting tube 215*d* that connects and holds the connecting tube 215*d* to the ventilating tube 217*a*. Ventilating tubes 217*a* and 217*b* are connected to each other by a first left end connector 221*a* that has spring connector 227*a*, where the spring connector 227*a* is a spring that pops into a hole of the ventilated tube 217*a* that connects and holds the ventilated tube 217*a* and the first left connector 221*a*. The first left connector 221*a* is connected to a first middle connector 223*a* with a plurality of holes having a spring connector 227*b*, where the spring connector 227*b* is a spring that pops into a hole of the first left connector 221*a* that connects and holds the first left connector 221*a* to the first middle connector 223*a*. First middle connector 223*a* having a spring connector 227*c* is connected to a first right end connector 225*a*, where the spring connector 227*c* is a spring that pops into a hole of the first right end connector 225*a* that connects and holds the first middle connector 223*a* to the right end connector 225*a*. Right connector end 225*a* has a spring connector 227*d*, where the spring connector 227*d* is a spring that pops into a hole in the ventilating tube 217*b* that connects and holds the right connector 225*a* to the ventilated tube 217*b*. Ventilated tube 217*b* has a spring connector 219*b* that is connected to the connecting tube 215*e* by the spring connector 219*b*, where the spring connector 219*b* is a spring that pops into a hole of the connecting tube 215*e* that connects and holds the connecting tube 215*e* to the ventilated tube 217*b*.

Next, connecting tube 215*f* connects to ventilating tube 217*c* having the spring connector 219*c*, where the spring connector 219*c* is a spring that pops into a hole of the connecting tube 215*f* that connects and holds the connecting tube 215*f* to the ventilating tube 217*c*. Ventilating tubes 217*c* and 217*d* are connected to each other by a second left end connector 221*b* that has a spring connector 227*e*, where the spring connector 227*e* is a spring that pops into a hole of the ventilated tube 217*c* that connects and holds the ventilated tube 217*c* and the second left connector 221*b*. The second left connector 221*b* is connected to a second middle connector 223*b* with a plurality of holes having a spring connector 227*f*, where the spring connector 227*f* is a spring that pops into a hole of the second left connector 221*b* that connects and holds the second left connector 221*b* to the second middle connector 223*b*. Second middle connector 223*b* having a spring connector 227*g* is connected to a first T-connector 229*a* by the spring connector 227*g*, where the spring connector 227*g* is a spring that pops into a hole of the first T-connector 229*a* that connects and holds the second middle connector 223*b* to the first T-connector 229*a*. First T-connector 229*a* has a spring connector 227*h* that is connected to the ventilated tube 217*d* by the spring connector 227*h*, where the spring connector 227*h* is a spring that pops into a hole of the ventilated tube 217*d* to connect and hold the first T-connector 229*a* to the ventilated tube 217*d*.

Next, connecting tube 215*g* connects to ventilating tube 217*d* having the spring connector 219*d*, where the spring connector 219*d* is a spring that pops into a hole of the connecting tube 215*g* that connects and holds the connecting tube 215*g* to the ventilating tube 217*d*. Ventilating tube 217*d* and ventilating tube 217*e* are connected by the first T-connector 229*a* connected by a third middle connector 223*c* with a plurality of holes having a spring connector 227*i*, where the spring connector 227*i* is a spring that pops into a hole of the first T-connector 229*a* that connects and holds the T-connector 229*a* to the third middle connector 223*c*. Third middle connector 223*c* includes a spring connector 227*j* that connects to a second T-connector 229*b*, where the spring connector 227*j* is a spring that pops into a hole of the third middle connector 223*c* that connects and holds the third middle connector 223*c* to the second T-connector 229*b*. Second T-connector 229*b* includes a spring connector 227*k* that is connected to the ventilating tube 217*e*, where the spring connector 227*k* is a spring that pops into a hole of the ventilating tube 217*e* that connects and holds the second t-connector 229*b* to the ventilating tube 217*e*. Ventilating tube 217*e* has a spring connector 219*e* that connects to the connecting tube 215*h*, where the spring connector 219*e* is a spring that pops into a hole of the connecting tube 215*h*, which connects and holds the connecting tube 215*h* to the ventilating tube 217*e*.

Next, a fourth middle connector 223*d* has a spring connector 227*l* that is connected to the second t-connector 229*b*, where the spring connector 227*l* is a spring that pops into a hole of the second t-connector 229*b* to connect and hold the second t-connector 229*b* to the fourth middle connector 223*d*. Fourth middle connector 223*d* has a spring connector 227*m* that is connected to a second right connector 225*b*, where the spring connector 227*m* is a spring that pops into a hole of the second right connector 225*b* to connect and hold the second right connector 225*b* to the fourth middle connector 223*d*. Second right connector 225*b* has a spring connector 227*n* that is connected to the ventilating tube 217*f*, where the spring connector 227*n* is a spring that pops into a hole of the ventilating tube 217*f* that connects and holds the second right connector 225*b* to the ventilating tube 217*f*. Connecting tube 215*i* is connected to the ventilating tube 217*f* that includes a spring connector 219*f*, where the spring connector 219*f* pops into a hole of the connecting tube 215*i* that connects and holds the connecting tube 215*i* to the ventilating tube 217*f*.

Next, connecting tube 215*j* is connected to ventilating tube 217*g* having the spring connector 219*g*, where the spring connector 219*g* is a spring that pops into a hole of the connecting tube 215*j* that connects and holds the connecting tube 215*j* to the ventilating tube 217*g*. The ventilating tube 217*g* is connected to the ventilating tube 217*h* by a third left end connector 221*c* that has a spring connector 227*o*, where the spring connector 227*o* is a spring that pops into a hole of the ventilating tube 217*g* that connects and holds the ventilating tube 217*g* to the third left end connector 221*c*. Third left end connector 221*c* is connected to a fifth middle connector 223*e* with a plurality of holes and a spring connector 227*p*, where the spring connector 227*p* is a spring that pops into a hole of the third left end connector 221*c* that connects and holds the third left end connector 221*c* to the fifth middle connector 223*e*. Fifth middle connector 223*e* having a spring connector 227*q* that is connected to a third right end connector 225*c*, where the spring connector 227*q* is a spring that pops into a hole of the third right end connector 225*c* that connects and holds the fifth middle connector 223*e* to the third right end connector 225*c*. Third right end connector 225*c* includes a spring connector 227*r* that is connected to the ventilating tube 217*h*, where the spring connector 227*r* is a spring that pops into a hole of the ventilating tube 217*h* that connects and holds the third right end connector 225*c* to the ventilated tube 217*h*. Ventilating tube 217*h* includes a spring connector 219*h* that connects to connecting tube 215*k*, where the spring connector 219*h* is a spring that pops into a hole of the connecting tube 215*k* that connects and holds the ventilating tube 217*h* to the connecting tube 215*k*.

Figure 4:
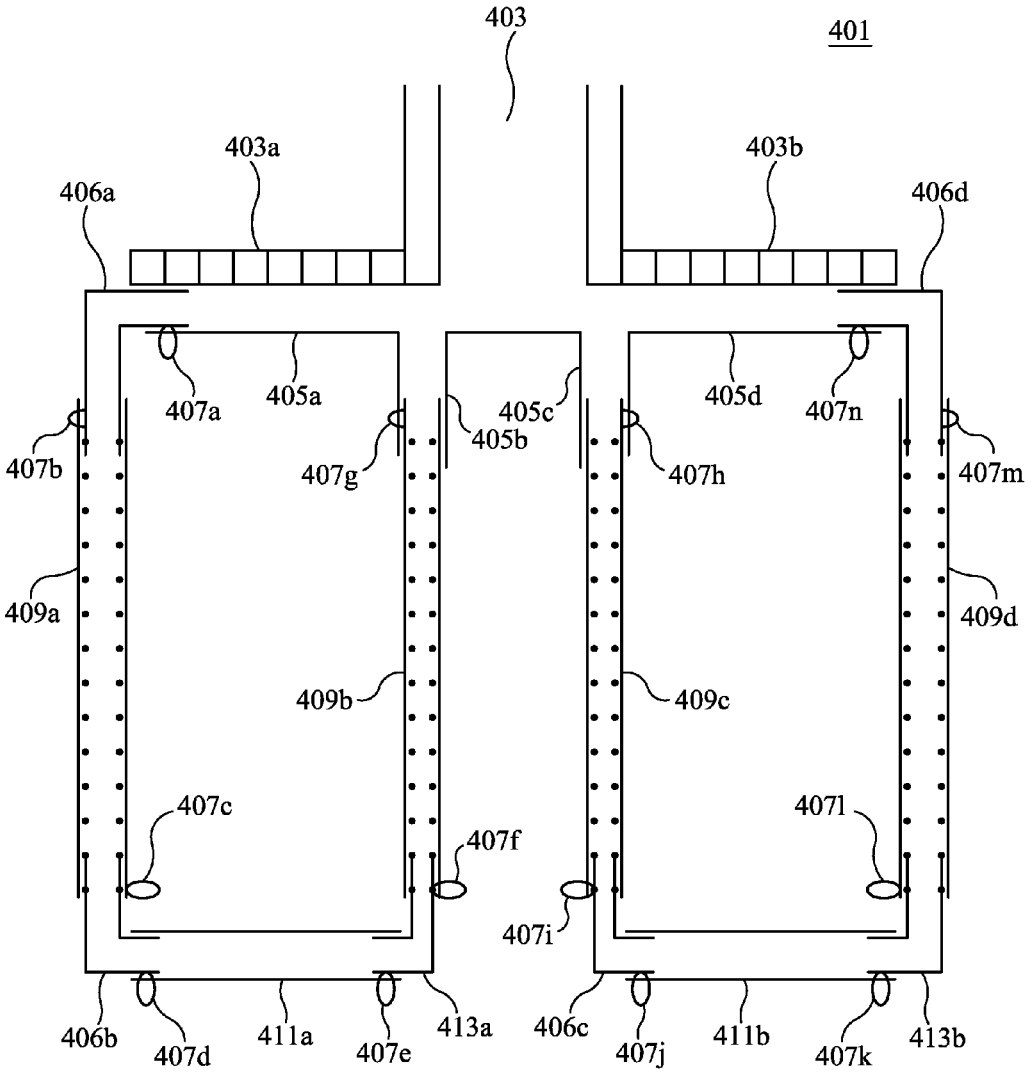
FIG. 4 shows another depiction of another detachable steaming component with the connecting tubes in accordance with the invention.

FIG. 4 is another description of another detachable steaming component. Detachable steaming component 401 is made of a hard durable plastic that can withstand heat, such as polyurethane, polyvinyl chloride (PVC) or polyolefin. For example, the detachable steaming component 401 may be a hollow rectangular structure that is a specially molded custom-made piece. Steaming component 401 has a waist band area 403, which includes vents 403*a* and 403*b* that expels steam to an article of clothing, such as a pair of pants that is placed on the detachable steaming component 401. The rectangular structure of the detachable steaming component 401 may have one or more connecting tubes. Connecting tubes 405*a*, 405*b*, 405*c* and 405*d* are connected respectively by springing connectors 407*a*, 407*b*, 407*c*, 407*d*, 407*e*, 407*f*, 407*g*, 407*h*, 407*i*, 407*j*, 407*k*, 407*l*, 407*m* and 407*n* to ventilating tubes 409*a*, 409*b*, 409*c* and 409*d*. The connecting tubes 405*a*, 405*b*, 405*c* and 405*d* are equivalent to connecting tubes 215*d*, 215*e*, 215*f*, 215*g*, 215*h*, 215*i*, 215*j* and 215*k* described above so a description will not be disclosed. Springing connectors 407*a*, 407*b*, 407*c*, 407*e*, 407*f*, 407*g* and 407*h* are similar to springing connectors 219*a*, 219*b*, 219*c*, 219*d*, 219*e*, 219*f*, 219*g* and, 219*h* is as described above to no description will not be provided herein. Ventilating tubes 409*a*, 409*b*, 409*c* and 409*d* is equivalent to ventilating tubes 217*a*, 217*b*, 217*c*, 217*d*, 217*e*, 217*f*, 217*g* and 217*h* described above so no other description will be provided.

In this embodiment, a first left connector 406*a* has a spring connector 407*a* that connects to connecting tube 405*a*, where the spring connector 407*a* has a spring that pops into a hole of the connecting tube 405*a* that connects and holds the first left connector 406*a* to the connecting tube 405*a*. First left connector 406*a* is connected to the ventilating tube 409*a* having a spring connector 407*b*, where the spring connector 407*b* is a spring that pops into a hole of the first left connector 406*a* that connects and holds the first left connector 406*a* to the ventilating tube 409*a*. A second left connector 406*b* having a spring connector 407*c* is connected to the ventilating tube 409*a*, where the spring connector 407*c* is a spring that pops into a hole of the ventilating tube 409*a* that connects and holds the ventilating tube 409*a* to the second left connector 406*b*. Second left connector 406*b* is connected to a first middle connector 411*a* with a plurality of holes that has a spring connector 407*d*, where the spring connector 407*d* is a spring that pops into a hole of the second left connector 406*b* that connects and holds the second left connector 406*b* to the first middle connector 411*a*. First middle connector 411*a* has a spring connector 407*e* that connects it to a first right end connector 413*a*, where the spring connector 407*e* is a spring that pops into a hole of the first right end connector 413*a* that connects and holds the first middle connector 411*a* to the first right end connector 413*a*. First right end connector 413*a* includes a spring connector 407*f* that connects to ventilating tube 409*b*, where the spring connector 407*f* is a spring that pops into a hole of the ventilating tube 409*b* that connects and holds the first right end connector 413*a* to the ventilating tube 409*b*. Ventilating tube 409*b* has a spring connector 407*g* that connects to the connecting tube 405*b*, where the spring connector 407*g* is a spring that pops into a hole of the connecting tube 405*b* that connects and holds the ventilating tube 409*b* to the connecting tube 405*b*.

Connecting tube 405*c* is connected to the ventilating tube 409*c* that has a spring connector 407*h*, where the spring connector 407*h* is a spring that that pops into a hole of the connecting tube 405*c* that connects and holds the ventilating tube 409*c* to the connecting tube 405*c*. A third left end connector 406*c* having a spring connector 407*i* is connected to the ventilating tube 409*c*, where the spring connector 407*i* is a spring that pops into a hole of the ventilating tube 409*c* that connects and holds the ventilating tube 409*c* to the third left connector 406*c*. Third left connector 406*c* is connected to a second middle connector 411*b* with a plurality of holes that has a spring connector 407*j*, where the spring connector 407*j* is a spring that pops into a hole of the third left connector 406*c* that connects and holds the third left connector 406*c* to the second middle connector 411*b*. Second middle connector 411*b* has a spring connector 407*k* that connects it to a second right end connector 413*b*, where the spring connector 407*k* is a spring that pops into a hole of the second right end connector 413*b* that connects and holds the second middle connector 411*b* to the second right connector 413*b*. Second right end connector 413*b* includes a spring connector 407*l* that connects to ventilating tube 409*d*, where the spring connector 407*l* is a spring that pops into a hole of the ventilating tube 409*d* that connects and holds the second right end connector 413*b* to the ventilating tube 409*d*. Ventilating tube 409*d* has a spring connector 407*m* that connects to a third right end connector 406*d*, where the spring connector 407*m* pops into a hole of the third right end connector 406*d* that connects and holds the ventilating tube 409*d* in the third right end connector 406*d*. Third right end connector 406*d* has a spring connector 407*n* that connects to the connecting tube 405*d*, where the spring connector 407*n* is a spring that pops into a hole of the connecting tube 405*d* that connects and holds the third right end connector 406*d* to the connecting tube 405*d*. Ventilating tubes 409*a*, 409*b*, 409*c* and 409*d* have a plurality of holes to expel steam and they have a length of approximately 6-36 inches.

Figure 5:
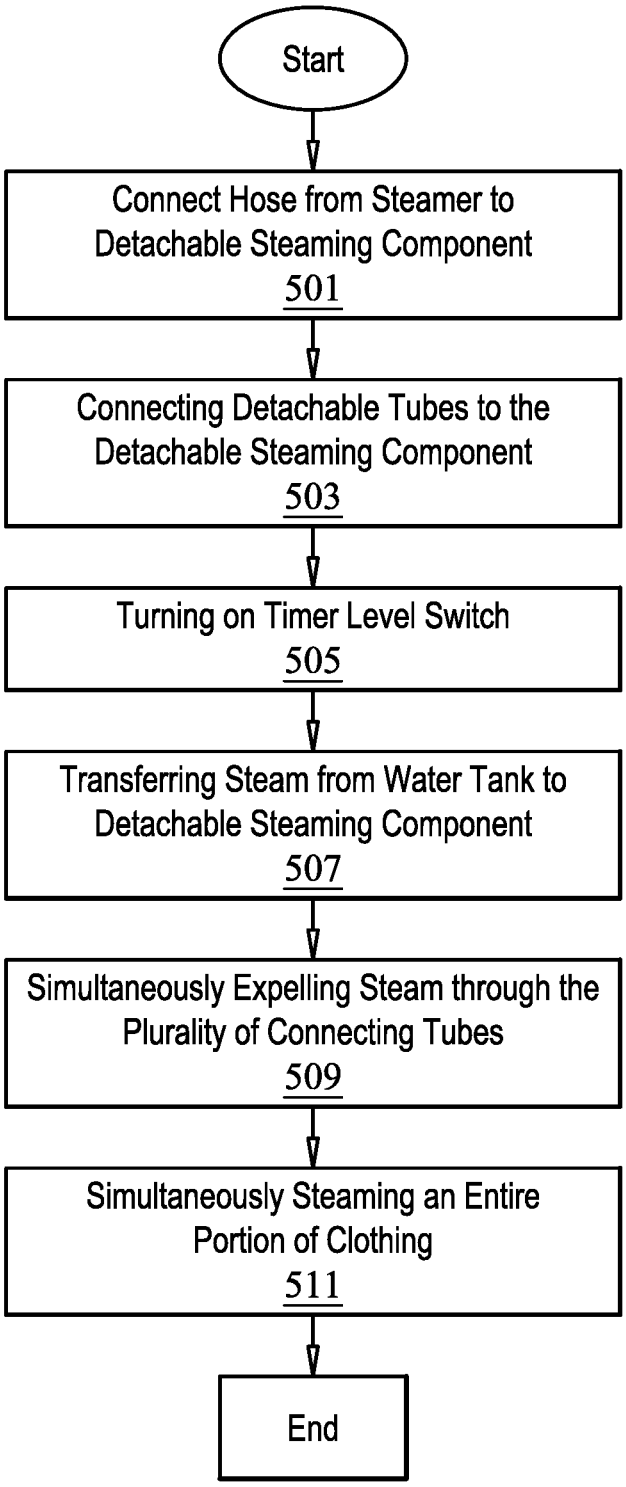
FIG. 5 is a flow-chart of how the steaming system of FIG. 2 is utilized in accordance with the invention.

FIG. 5 is an embodiment of how the detachable steaming component of FIG. 2 is utilized. At block 501, the hose 205 is connected from the steamer system 200 to the steam component 215 having the plurality of connecting tubes 215*d*, 215*e*, 215*f*, 215*g*, 215*h*, 215*i* and 215*k*. Next at block 503, the plurality of connecting tubes 215*d*, 215*e*, 215*f*, 215*g*, 215*h*, 215*i* and 215*k* are connected by springing connectors 219*a*, 219*b*, 219*c*, 219*d*, 219*e*, 219*f*, 219*g* and 219*h* to the detachable ventilating tubes 217*a*, 217*b*, 217*c*, 217*d*, 217*e*, 217*f*, 217*g* and 217*h* (FIG. 3) of the steaming component 215.

Next, at block 505 a person turns on the OFF temperature and Timer/Level setting steam switch at 201*b* (FIG. 2) that dictates where and how the pressure steam will be generated from the water tank 201 and sent through the hose 205 to the steam component 215. This Level 201*b* also activates the heating element 201*a* to start heating the water 203 in the water tank 201, where the heating element 201*a* connected to the electrical cord 211. Next, at block 507, after a particular time is chosen at the OFF temperature and Timer/Level steam switch 201*b* such as 1 minute to build up pressure steam in the water tank 201, then the steam is transferred from the water tank 201 through the hose 205 through the male connector 205*a* to the female connector 205*b* into the detachable steam component 215.

Next at block 509, the steam goes through the detachable steam component 215 then the steam is simultaneously expelled through the plurality of holes of the detachable ventilated tubes 217*a*, 217*b*, 217*c*, 217*d*, 217*e*, 217*f*, 217*g* and 217*h* by using the direct pathways of the connecting tubes 215*d*, 215*e*, 215*f*, 215*g*, 215*h*, 215*i*, 215*j* and 215*k*. Next, at block 511 as the steam is simultaneously expelled through the plurality of holes of the ventilated tubes 217*a*, 217*b*, 217*c*, 217*d*, 217*e*, 217*f*, 217*g*, and 217*h* where an entire portion of article of clothing covering the detachable steaming component 215 is being steamed for a period of time, for example 1-5 minutes depending on the article of clothing. The article of clothing may be a shirt, blouse, dress, pair of pants, jeans, suit, coat etc. depending on the form of the article of clothing. After the clothing is steamed, then the clothing is removed from the detachable steaming component 215.

Figure 6:
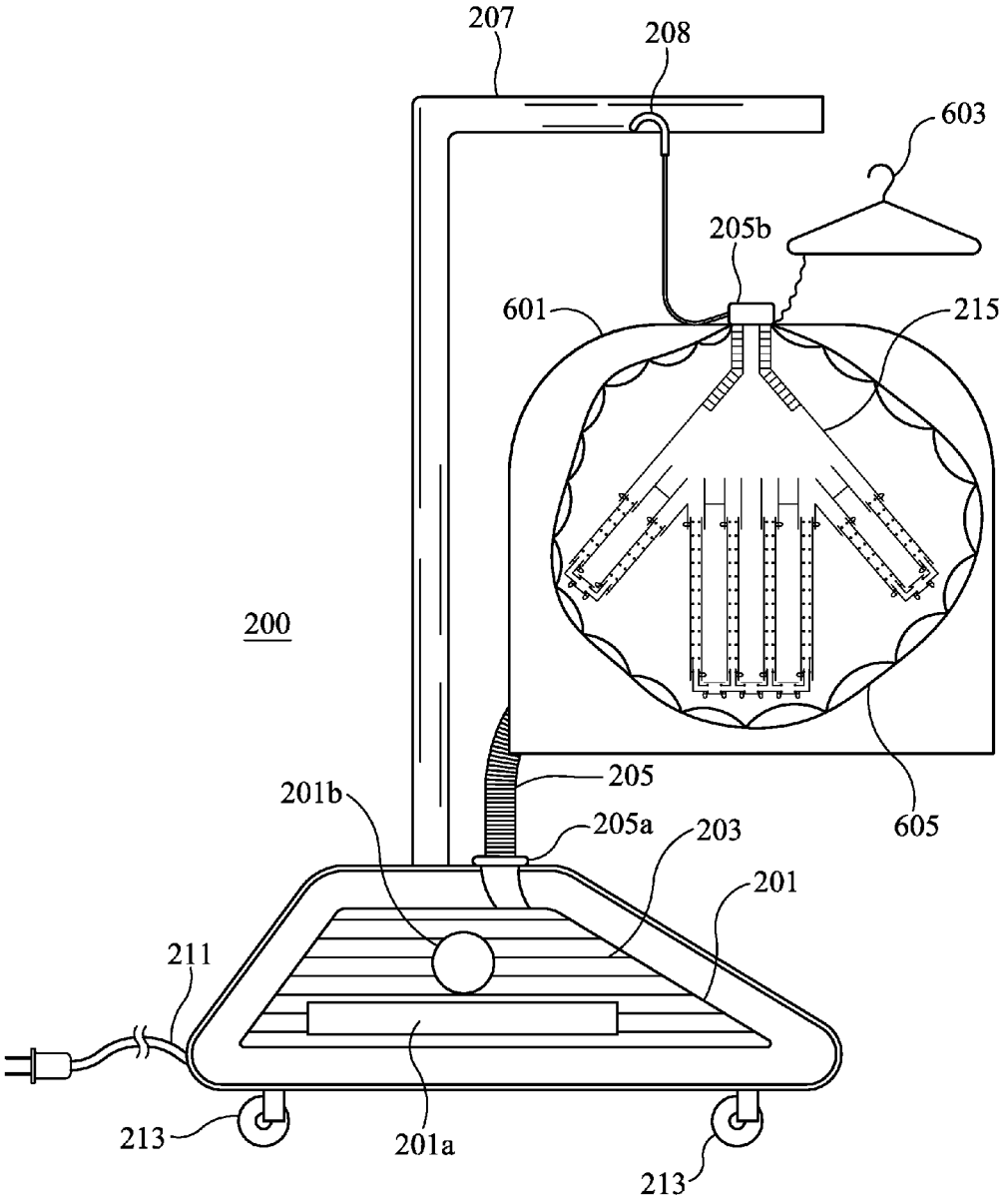
FIG. 6 is an illustration of the steaming system of FIG. 2 in accordance with the invention that also includes a detachable steamer bag.

FIG. 6 is an illustration of an entire steaming system with a detachable steamer bag, which includes all the components of FIG. 2 that will not be recited here again except for a detachable steamer bag 601. Detachable steamer bag 601 also known as the "DSB" is a bag that can be used with the steamer 200. DSB 601 is made out of a special plastic and heat retardant material, this is so the steam stays inside of the bag for longer periods of time and doesn't easily escape the bag when being used. The steam is the steam that is produced and received from the steamer 200 when the steamer 200 is activated. The DSB 601 allows the steam to stay in the bag 601 for a period of time so the clothes that are placed in the DSB bag 601 are fully steamed until the clothes or materials are wrinkle free. The clothes or materials are placed in the DSB with a basic plastic heat resistant hanger 603. The hanger 603 can hold any size clothes or materials from a child size to an adult size clothing and can hold up too 20 lbs in weight ire materials. The hanger 603 is a part of the DSB 601. The DSB 601 receives the steam directly from the steamer unit 200 from the bottom center part of the bag with a plastics connecting hole that connects to the steamer unit hose 205. On the opposite side of the bag 601 is where the zipper 605 is placed that will be placed in the center of the bag 601 vertically and will be the length of about 2 ft. The zipper 605 represents the opening of the bag 601 area is where the clothes will be placed in and removed from the DSB 601. The DSB 601 will allow the steamer unit 200 to work and function with clothes and different materials of all shapes and sizes easily and quickly, which is good for saving time and less difficultly when using. You can also use the DSB 601 to steam out other materials such as bed sheets, scarfs, curtains and many other type of material that can be hung on the DSB hanger 603 and placed inside of the DSB 601 to be steamed out so it is wrinkle free!

Figure 7:
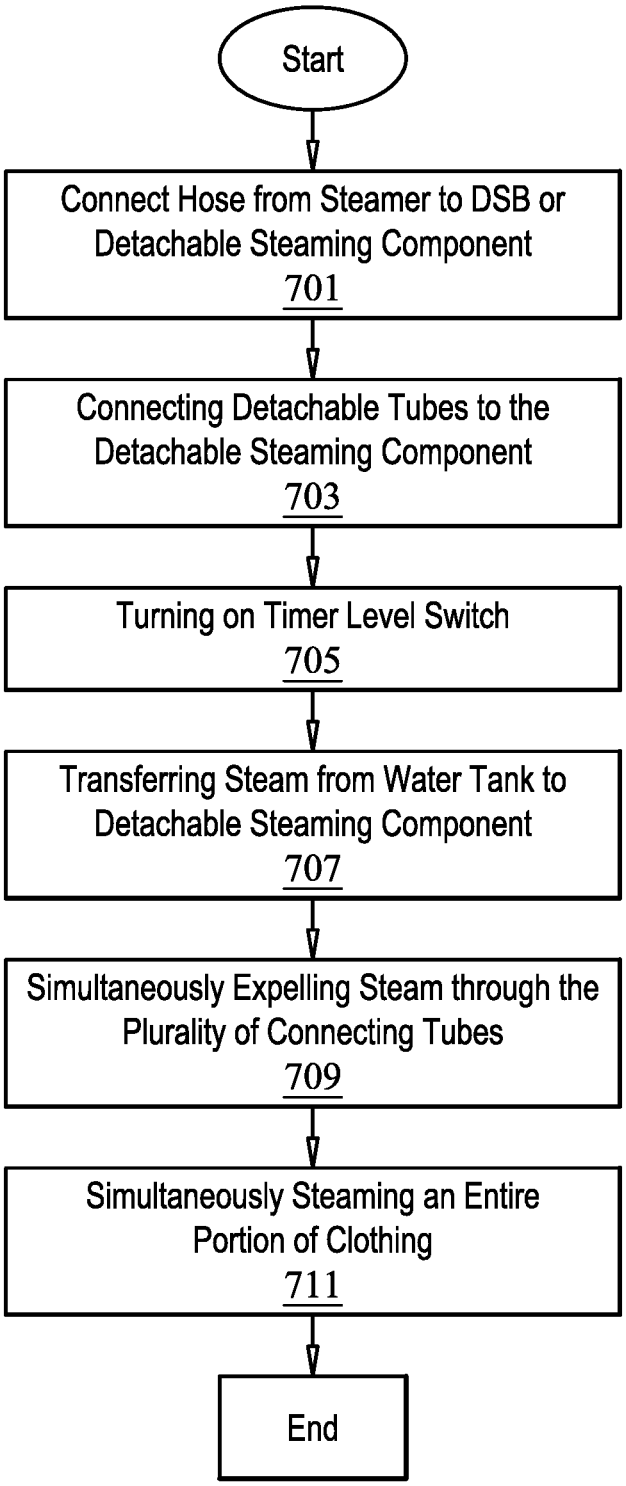
FIG. 7 is a flow chart of how the steaming system of FIG. 6 is utilized in accordance with the invention.

FIG. 7 is an embodiment of how the detachable steaming component of FIG. 6 is utilized. At block 701, the hose 205 is connected from the steamer system 200 to the DSB 601 or steam component 215 having the plurality of connecting tubes 215*d*, 215*e*, 215*f*, 215*g*, 215*h*, 215*i* and 215*k*. Next at block 703, the plurality of connecting tubes 215*d*, 215*e*, 215*f*, 215*g*, 215*h*, 215*i* and 215*k* are connected by springing connectors 219*a*, 219*b*, 219*c*, 219*d*, 219*e*, 219*f*, 219*g* and 219*h* to the detachable ventilating tubes 217*a*, 217*b*, 217*c*, 217*d*, 217*e*, 217*f*, 217*g* and 217*h* (FIG. 3) of the steaming component 215. DSB 601 is configured to hold the steam in to steam an entire portion of the article of clothing, Next, at block 705 a person turns on the OFF temperature and Timer/Level setting steam switch at 201*b* (FIG. 6) that dictates where and how the pressure steam will be generated from the water tank 201 and sent through the hose 205 to the DSB 601 or steam component 215. This Level 201*b* also activates the heating element 201*a* to start heating the water 203 in the water tank 201, where the heating element 201*a* connected to the electrical cord 211. Next, at block 707, after a particular time is chosen at the OFF temperature and Timer/Level steam switch 201*b* such as 1 minute to build up pressure steam in the water tank 201, then the steam is transferred from the water tank 201 through the hose 205 through the male connector 205*a* to the female connector 205*b* into the DSB 601 or to detachable steam component 215.

Next at block 709, the steam goes through the DSB 601 or detachable steam component 215 then the steam is simultaneously expelled through the plurality of holes of the detachable ventilated tubes 217*a*, 217*b*, 217*c*, 217*d*, 217*e*, 217*f*, 217*g* and 217*h* by using the direct pathways of the connecting tubes 215*d*, 215*e*, 215*f*, 215*g*, 215*h*, 215*i*, 215*j* and 215*k*. The DSB 601 or the specialized steamer bag is configured to hold the steaming component having the plurality of connecting tubes, the plurality of spring connectors with the plurality of springs to hold the steam in.

Next, at block 711 as the steam is simultaneously expelled through the plurality of holes of the ventilated tubes 217*a*, 217*b*, 217*c*, 217*d*, 217*e*, 217*f*, 217*g*, and 217*h* where an entire portion of article of clothing covering the detachable steaming component 215 or in the DSB 601 is being steamed for a period of time, for example 1-5 minutes depending on the article of clothing. The article of clothing may be a shirt, blouse, dress, pair of pants, jeans, suit, coat etc. depending on the form of the article of clothing. After the clothing is steamed, then the clothing is removed from the DSB 601 or the detachable steaming component 215.

This invention provides a worry free and hand free safe simple system for steaming a shirt, blouse, pants or dress. A person is able to utilize this steaming system to steam the wrinkles out of any article of clothing in the DSB 601 whereby they can place the article of clothing on a steam component with a plurality of connecting tubes, and then initiate the steaming system where the entire clothing is steamed without any further interaction by a user. A specially made DSB and steam component having a plurality of connecting tubes and specially made ventilated tubes is able to fit any type of clothing where the steaming component includes an opening to receive steam from a hose, then the plurality of connecting tubes connected to a plurality of ventilated tubes receives the steam that is simultaneously expel steam through a plurality of holes in the plurality of ventilated tubes causing the article of clothing surrounding the detachable steam component to be steamed.

What is claimed is:

1. A system for steaming clothes comprising:

a steamer is connected through a hose to a steaming component having a plurality of connecting tubes, wherein the steaming component having the plurality of connecting tubes, wherein the plurality of connecting tubes connects to a plurality of detachable ventilating tubes, wherein a plurality of spring connectors with a plurality of springs securely connects the plurality of connecting tubes to the plurality of detachable ventilating tubes, wherein the plurality of the detachable ventilating tubes have a plurality of holes to expel steam;

the steaming component with the plurality of connecting tubes is configured to hold an article of clothing that fits around the steaming component and the plurality of connecting tubes, wherein the steaming component is configured to receive steam from the steamer to expel the steam through the plurality of holes to entirely steam an entire portion of the article of clothing; and a specialized heat-retardant steamer bag configured to hold the steaming component having the plurality of connecting tubes, the plurality of spring connectors with the plurality of springs for the specialized heat-retardant steamer bag to hold the steam to steam the entire portion of the article of clothing, wherein the steam is simultaneously expelled through the plurality of holes of the plurality of detachable ventilating tubes.

2. The system of claim 1, wherein the steaming component with the plurality of connecting tubes and the plurality of detachable ventilating tubes is capable of holding a shirt.

3. The system of claim 1, wherein the steamer has an off level operating switch.

4. The system of claim 1, wherein the specialized heat-retardant steamer bag is made of special plastic that is heat retardant.

5. A method for steaming clothes, the method comprising:

connecting a hose from a steamer to a steaming component with a plurality of connecting tubes;

connecting the plurality of connecting tubes to a plurality of detachable ventilated tubes whereby a plurality of spring connectors with a plurality of springs securely connects the plurality of connecting tubes to the plurality of detachable ventilated tubes;

transferring steam from the steamer to the steaming component and the plurality of connecting tubes through the plurality of detachable ventilated tubes;

transferring the steam through the plurality of detachable ventilated tubes that includes a plurality of holes;

providing a specialized heat-retardant steamer bag configured to hold the steaming component having the plurality of connecting tubes, the plurality of spring connectors with the plurality of springs for the specialized heat-retardant steamer bag to hold the steam to steam an entire portion of an article of clothing; and simultaneously expelling the steam through the plurality of holes, wherein the steam is simultaneously expelled through the plurality of holes of the plurality of detachable ventilated tubes.

6. The method of claim 5, further comprising covering the steaming component with the article of clothing.

* * * * *